US006772912B1

(12) United States Patent
Schall et al.

(10) Patent No.: US 6,772,912 B1
(45) Date of Patent: Aug. 10, 2004

(54) LIQUID STORAGE AND DISPENSING TANK

(76) Inventors: James L. Schall, 1824 W. Division St., Grand Island, NE (US) 68803; Steve J. Mertens, 10821 Romona Dr., Lincoln, NE (US) 68516

( * ) Notice: Subject to any disclaimer, the term of this patent is extended or adjusted under 35 U.S.C. 154(b) by 198 days.

(21) Appl. No.: 10/196,023

(22) Filed: Jul. 15, 2002

(51) Int. Cl.[7] ..... B67D 5/60
(52) U.S. Cl. ..... 222/143; 222/185.1
(58) Field of Search ..... 222/129, 143, 222/185.1

(56) References Cited

U.S. PATENT DOCUMENTS

| | | | | |
|---|---|---|---|---|
| 2,457,842 | A | | 1/1949 | Smith et al. |
| 3,281,006 | A | * | 10/1966 | Tohchung ..... 220/4.27 |
| 3,406,855 | A | | 10/1968 | McKechnie |
| 4,648,521 | A | | 3/1987 | Thomas et al. |
| 4,746,034 | A | | 5/1988 | Ata et al. |
| 5,199,570 | A | * | 4/1993 | McKenzie ..... 206/503 |
| 5,361,906 | A | | 11/1994 | Sterett |
| 5,465,865 | A | | 11/1995 | Coombes |
| 5,501,334 | A | | 3/1996 | Przytulla et al. |
| 5,544,777 | A | | 8/1996 | Watson |
| 5,564,599 | A | | 10/1996 | Barber et al. |
| 5,645,185 | A | | 7/1997 | Cassina |
| 5,704,477 | A | | 1/1998 | Hermann et al. |
| 6,135,324 | A | | 10/2000 | Schmitt |
| 6,318,598 | B1 | | 11/2001 | Schmitt |

* cited by examiner

*Primary Examiner*—Gregory L. Huson
*Assistant Examiner*—Patrick Buechner

(57) ABSTRACT

A liquid storage and dispensing tank for use individually or for use in a stacked manner. The tank has an upper sump formed therein which collects the liquid in the tank when the tank has been turned upside down to completely drain liquid from the tank. The upper end of the tank has a pocket formed in a raised central portion thereof which receives a bottom sump of a tank stacked thereupon. The tank has a pair of forklift pockets formed in the bottom thereof which are accessible from the front of the tank. The tank also has conveniently accessible fill and drain openings. The tank is comprised of one-piece plastic and is formed by rotational molding or the like.

28 Claims, 5 Drawing Sheets

LIQUID STORAGE AND DISPENSING TANK

BACKGROUND OF THE INVENTION

1. Field of the Invention

This invention relates to a liquid storage and dispensing tank and more particularly to a liquid storage and dispensing tank for use in a liquid storage system wherein a pair of the tanks may be stacked one upon the other.

2. Description of the Related Art

Many types of plastic tanks have been previously provided for the storage and dispensing of liquids such as lubricants, chemicals, etc. Further, many storage and dispensing systems have been provided where identical plastic tanks are stacked one upon the other so that the liquids therein may be stored and dispensed therefrom while occupying a minimum amount of floor space. However, the prior art tanks are believed to have several shortcomings. Many of the prior art liquid storage and dispensing tanks are not able to be conveniently filled whether the tanks are being used individually or are stacked one upon the other due to the placement of the fill opening or the number thereof. Further certain of the prior art plastic storage and dispensing tanks do not have forklift pockets which are accessible from the front of the tank. Additionally, in certain of the prior art tanks having drain valves positioned in the lower forward end thereof, the drain valves are not sufficiently recessed to prevent damage to the drain valve. Yet another disadvantage of the prior art tanks is that it is difficult to completely drain the liquid product therefrom when it is desired to completely drain the tank as is necessary when the tank is going to be used to store and dispense a different liquid product.

SUMMARY OF THE INVENTION

A plastic tank or container for storing and dispensing a liquid is disclosed including a front wall, back wall, opposite side walls, a top and a bottom. The top of the tank has a raised central portion which has a pocket formed therein. A top sump extends upwardly from the top of the tank adjacent the back wall thereof and has a selectively closable drain/fill opening formed therein. The bottom of the tank has an elongated bottom sump formed therein extending between the front and back walls thereof. The forward end of the bottom sump is recessed and has a selectively closable drain opening formed therein into which a drain valve may be positioned. The top of the tank has a selectively closable fill opening formed therein adjacent one of the opposite side walls which is easily accessible when a pair of tanks are stacked one upon the other. If desired, the rearward end of the bottom sump may also have a selectively closable drain opening formed therein. When one tank is stacked upon another, the lower end of the bottom sump of the uppermost tank is received in the pocket formed in the raised central portion of the tank positioned therebelow. The tank has a pair of spaced-apart forklift pockets formed therein in the bottom thereof which extend between the front and back wall. The forward end of the bottom sump is recessed inwardly of the front wall as stated so that a drain valve positioned therein is recessed inwardly of the front wall. When it is desired to completely drain the liquid in the tank therefrom, the tank is inverted and the product remaining in the tank is drained therefrom through the drain opening in the top sump which is now located at the lowermost portion of the tank.

It is therefore a principal object of the invention to provide an improved liquid storage and dispensing tank.

Yet another object of the invention is to provide an improved liquid storage and dispensing tank for use in a liquid storage system wherein a pair of the tanks are stacked one upon the other.

Still another object of the invention is to provide a liquid storage and dispensing tank having conveniently accessible fill openings when the tanks are stacked one upon the other.

Still another object of the invention is to provide a tank of the type described having forklift pockets which are accessible from the front of the tank for easy transporting and stacking.

Still another object of the invention is to provide a tank of the type described having front and rear fill openings formed therein.

Still another object of the invention is to provide a liquid storage and dispensing tank having a bottom sump with a recessed forward end which positions a drain valve therein inwardly of the front of the tank.

Still another object of the invention is to provide a liquid storage and dispensing tank having a top sump formed therein which facilitates complete drainage of the tank when the tank has been turned upside down.

Still another object of the invention is to provide a liquid storage tank which, when stacked upon another, has a fill port located by the service valve.

Still another object of the invention is to provide a liquid storage and dispensing tank having a bottom sump which will accommodate a lube pump.

These and other objects will be apparent to those skilled in the art.

DESCRIPTION OF THE PREFERRED EMBODIMENT

Figure 1:
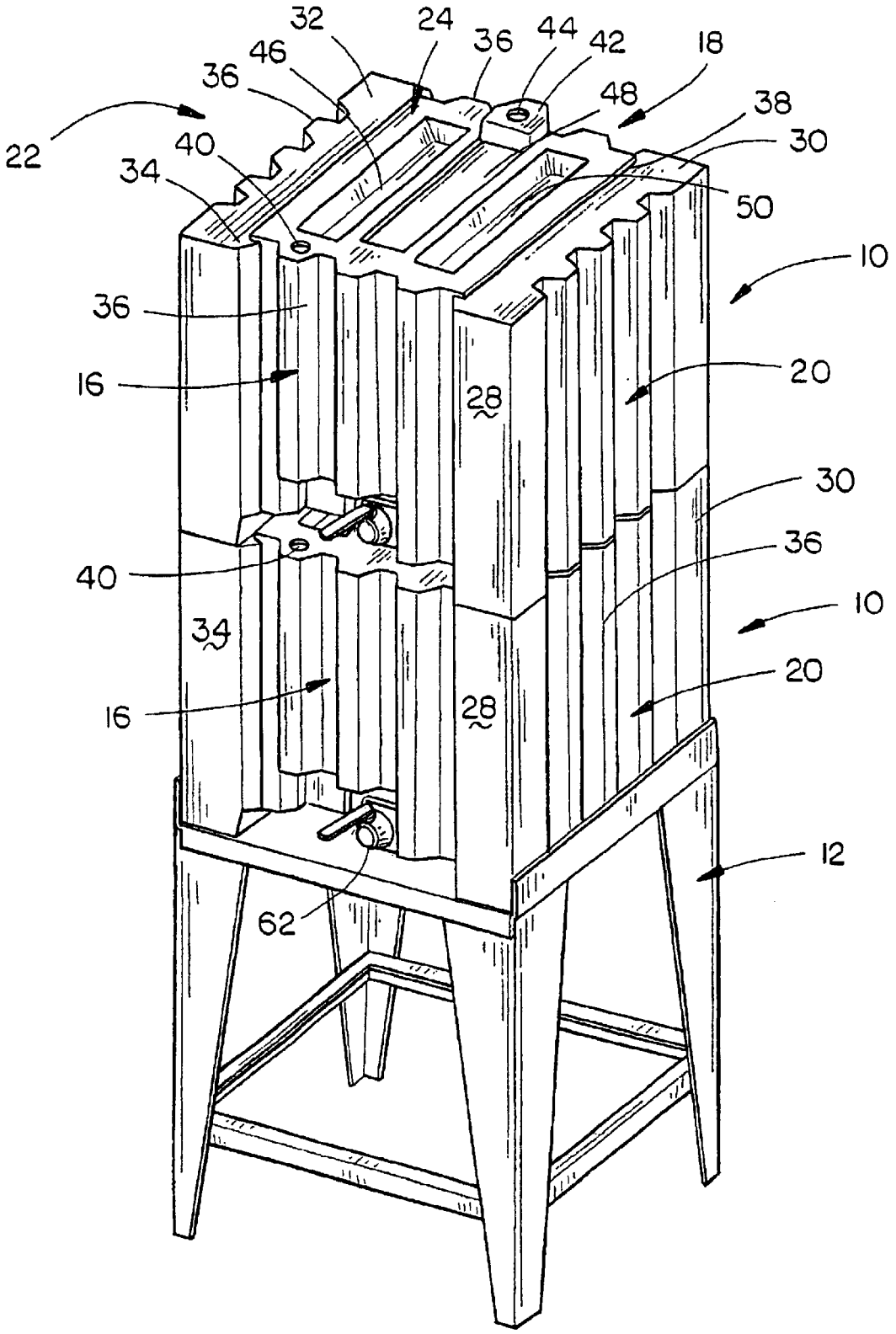
FIG. 1 is a perspective view of the liquid storage system of this invention wherein a pair of the liquid storage and dispensing tanks are stacked one upon the other with the lowermost tank being supported upon a stand or rack.
Figure 3:
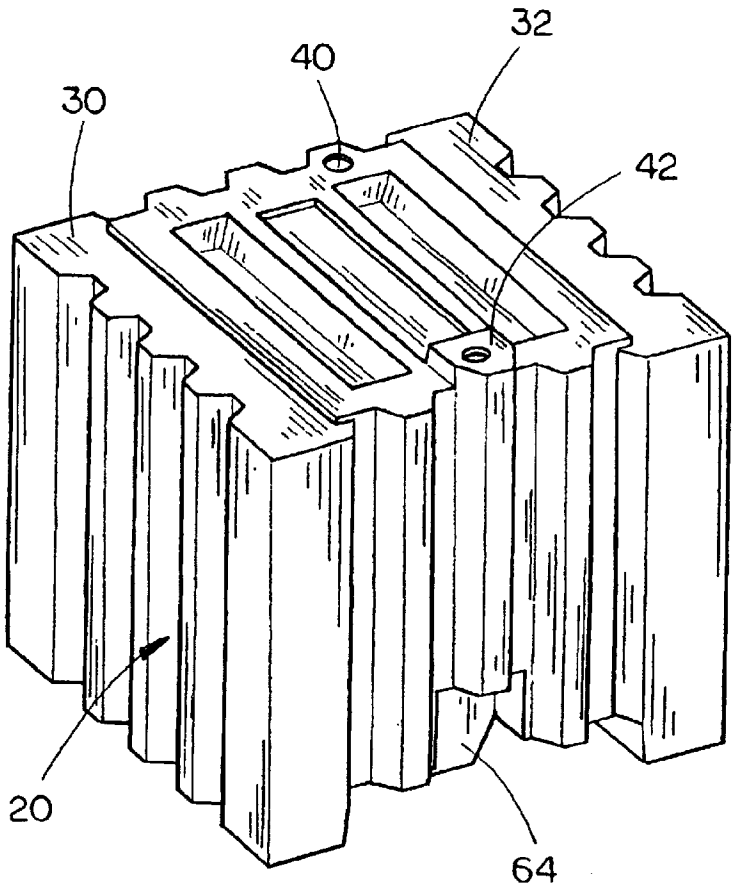
FIG. 3 is a rear perspective view of the tank of this invention.
Figure 2:
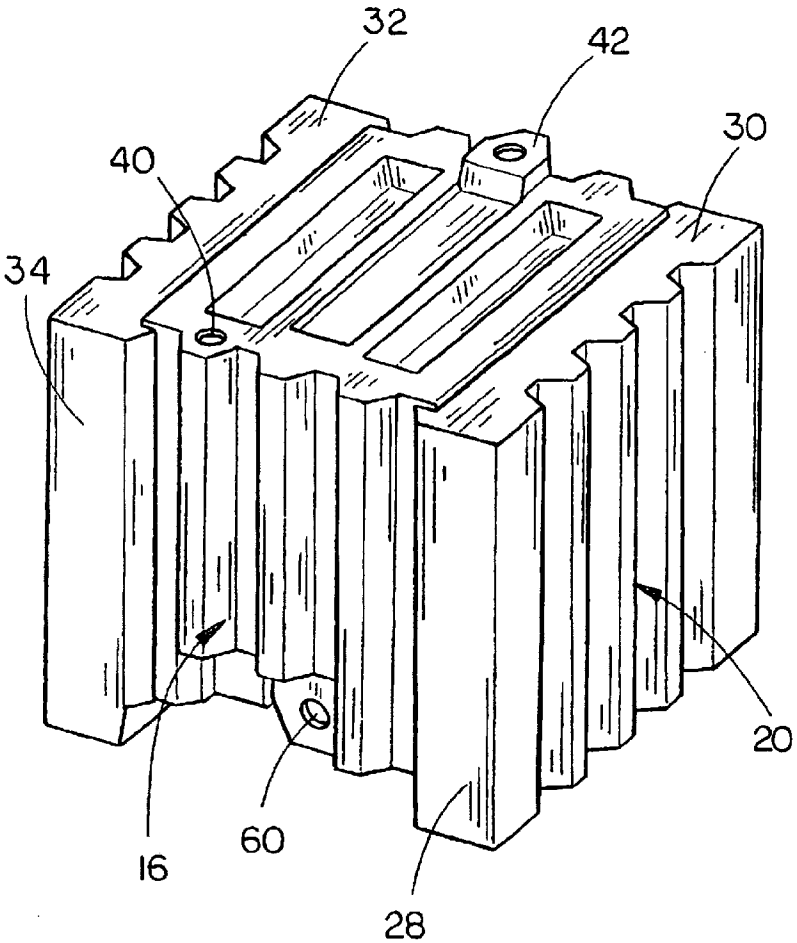
FIG. 2 is a front perspective view of the tank of this invention.
Figure 4:
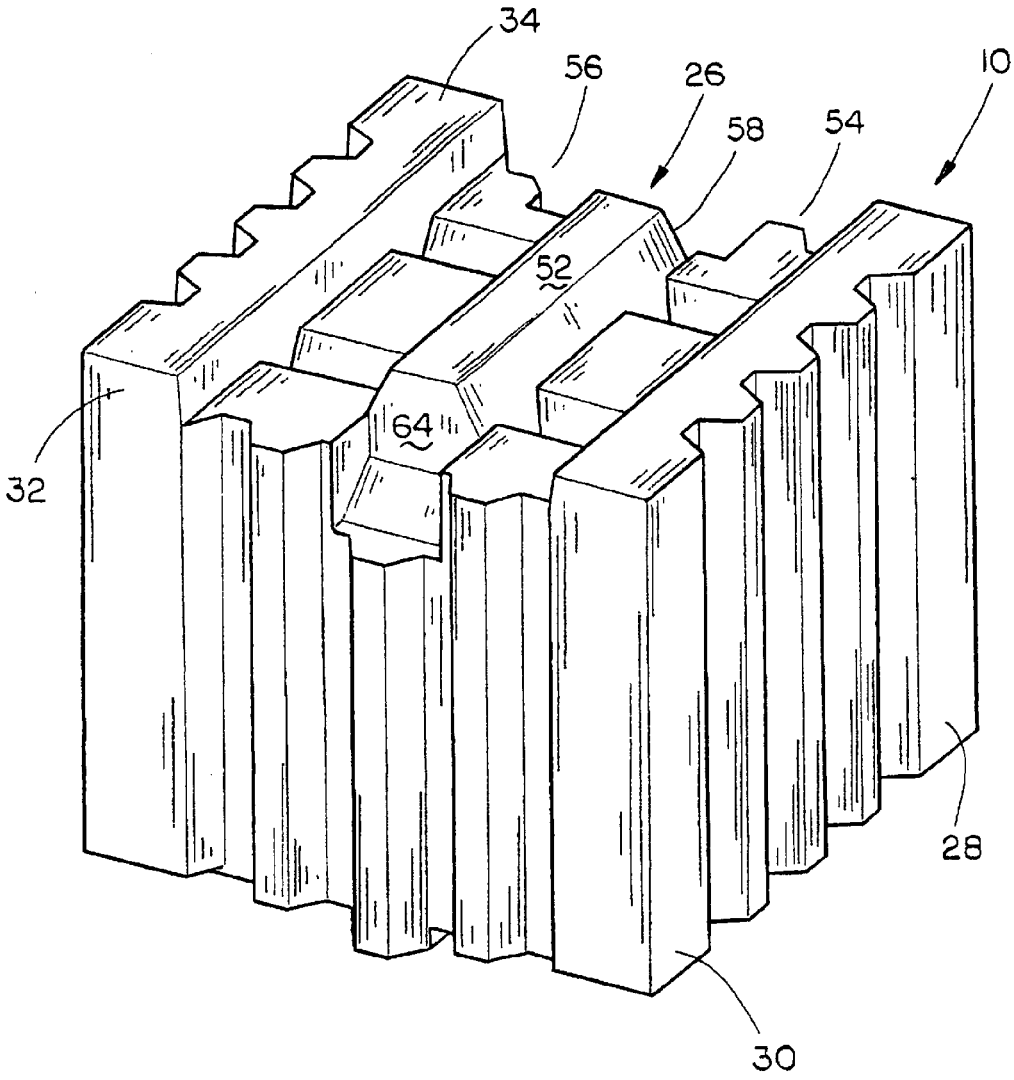
FIG. 4 is a rear bottom perspective view of the tank of this invention.
Figure 5:
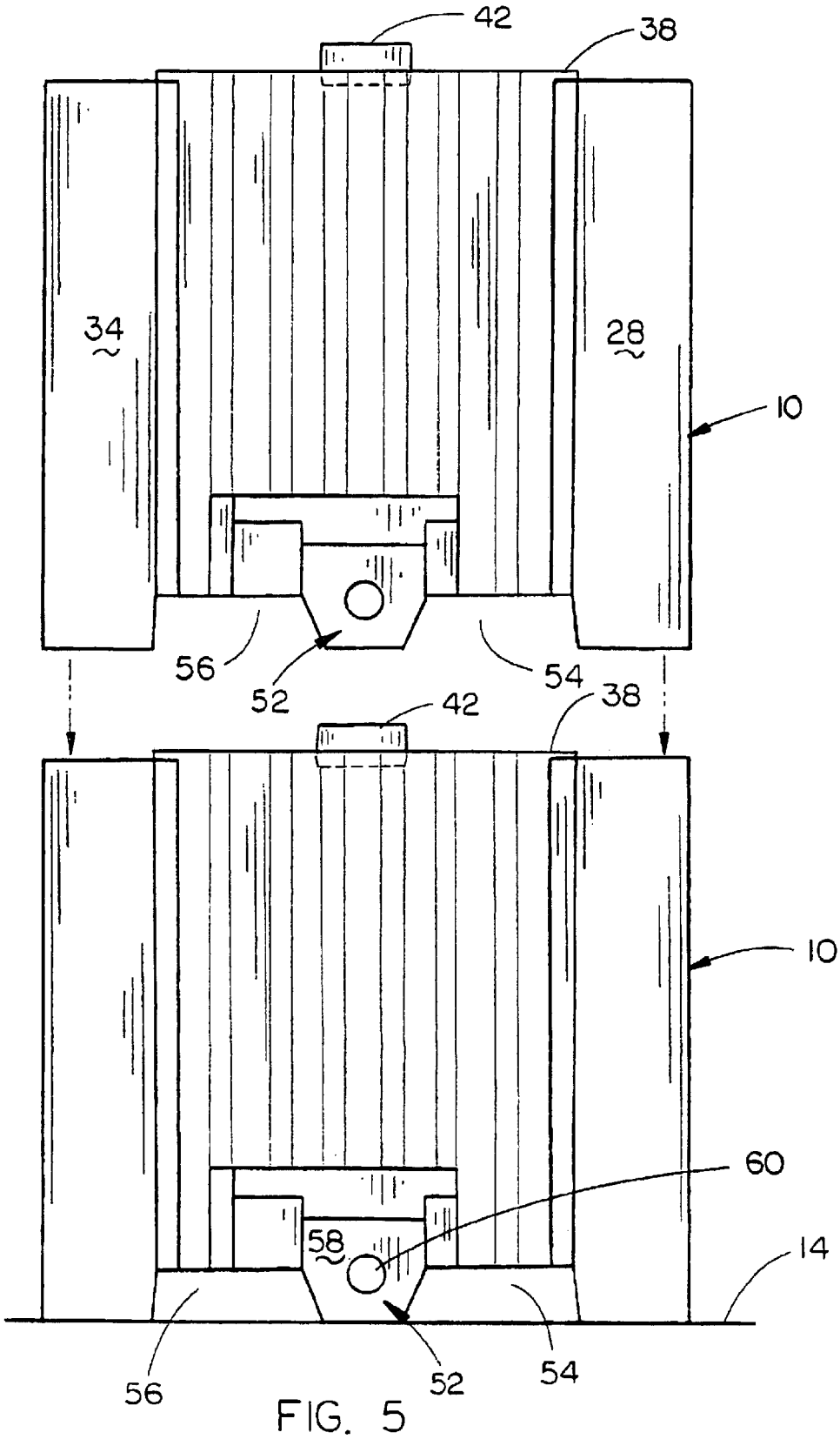
FIG. 5 is an exploded view illustrating the manner in which one tank is stacked upon another tank.
Figure 6:
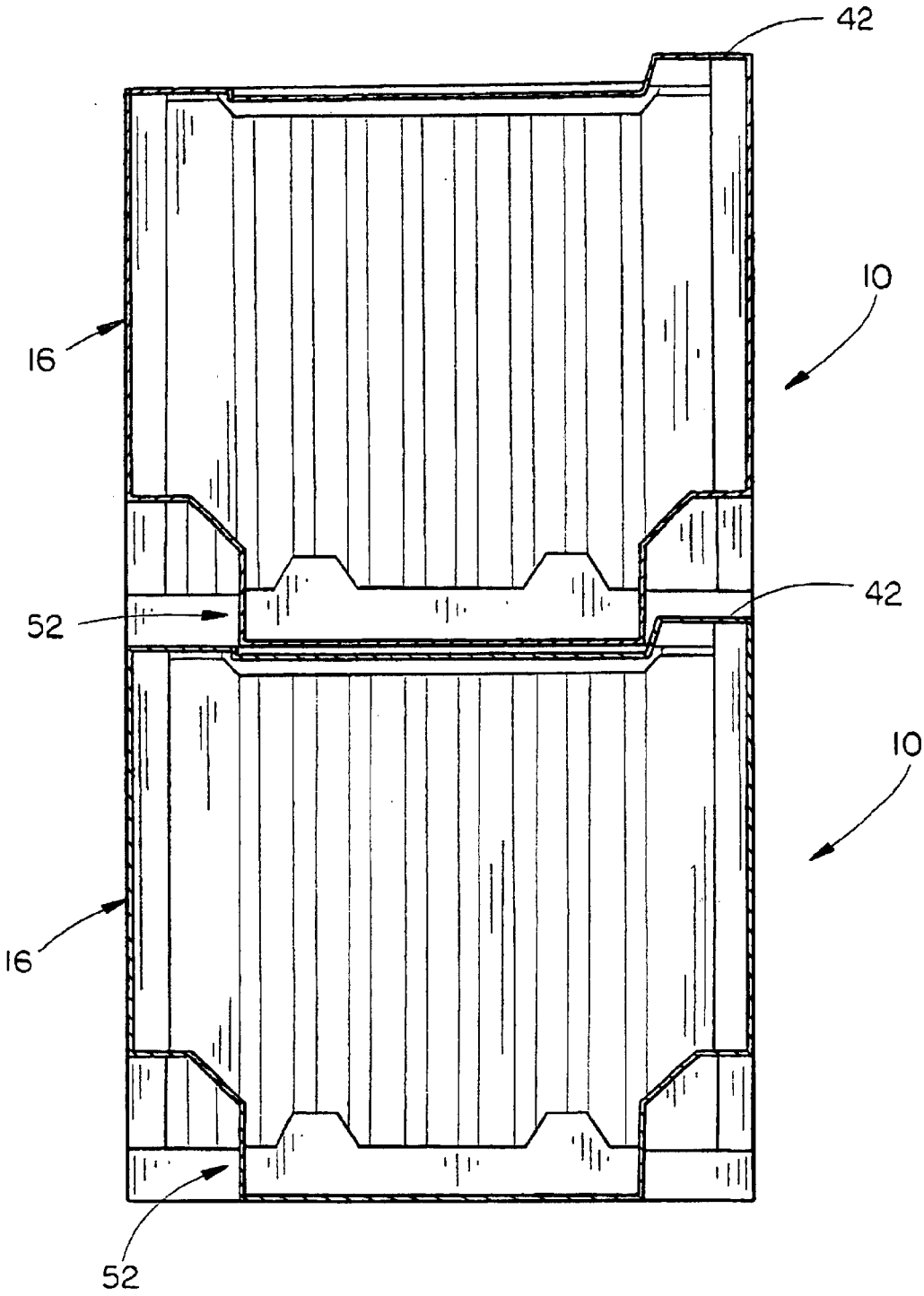
FIG. 6 is a sectional view illustrating a pair of the tanks of this invention stacked one upon the other.

The liquid storage tank of this invention is generally referred to by the reference numeral 10. As seen in FIG. 1, a pair of tanks 10 may be arranged so that one tank 10 is stacked upon another tank 10 with the bottommost tank 10 being positioned on a rack or stand 12. The stacked tanks 10 may also be positioned on a horizontal support surface 14 such as a floor or the like (FIG. 5).

Tank 10 is a one-piece container made of plastic, such as polyethylene, by a rotational molding process. The plastic must be compatible with the liquid being stored within the tank which may be lubricants, chemicals, etc. For purposes of description, tank 10 will be described as including a front wall 16, back wall 18, side walls 20 and 22, top 24, and bottom 26. Leg 28 is provided at the intersection of walls 16 and 20. Leg 30 is provided at the intersection of walls 18 and 20 while leg 32 is provided at the intersection of walls 18 and 22. Leg 34 is provided at the intersection of walls 16 and 22. Each of the walls 16, 18, 20 and 22 has vertically disposed ribs 36 formed therein for strengthening purposes with those ribs having a rounded radius design. Top 24 of tank 10 includes a raised central portion 38 which is elevated above the upper ends of legs 28, 30, 32 and 34. A closable fill opening 40 is formed in the forward portion of central portion 38 which is in communication with the upper end of the left-most rib 36 in front wall 16 (FIG. 1). Top sump 42 extends upwardly from the center rib 36 in back wall 18 and has a closable opening 44 formed therein for drainage purposes when the tank 10 is turned upside down. When tank 10 is in its normal upright position, opening 44 serves as a fill opening. Central portion 38 of top 24 has three pockets or recesses 46, 48 and 50 formed therein (FIG. 1).

Bottom 26 of tank 10 includes a tapered bottom sump 52 which is positioned between a pair of forklift pockets 54 and 56 formed in the bottom 26. The forward end 58 of sump 52 is recessed inwardly of front wall 16, as seen in FIG. 1. The forward end 58 of sump 52 is provided with an opening 60 formed therein for receiving a control or drain valve 62 or a lube pump. When the tanks 10 are stacked on upon the other, the lower end of sump 52 of the uppermost tank is received within pocket 48 in the lower tank to securely maintain the tanks in their stacked position. In the stacked position, the lower end of sump 52 on the lowermost tank rests on the surface 14. Obviously, when only a single tank 10 is being used, the lower end of sump 52 rests on the surface 14. If desired, a drain may also be formed in the rear end 64 of sump 52 for receiving a drain valve therein if desired.

The tank of this invention is convenient to use due to the front accessible forklift pockets 54 and 56 for easy transporting and stacking. The location of the front fill opening 40 is not only convenient to use when an individual tank is being filled, but is readily accessible when the tanks are stacked one upon the other, as illustrated in FIG. 1. The fact that the forward end of the bottom sump 52 is recessed inwardly of the front wall of the tank places the control valve 62 out of harm's way, thereby preventing damage to the same. The bottom sump 52 not only accommodates a control valve 62, but the same will also accommodate a lube pump. Additionally, the rear end of the bottom sump 52 may have an opening formed therein for purposes of drainage or for receiving a lube pump therein. When the tanks are stacked one upon the other, the reception of the lower end of the sump 52 into the pocket 48 of the lower tank ensures that the tanks will be safely and securely maintained in their stacked condition.

When it is desired to completely drain the tank 10, the tank is inverted or turned upside down which causes the remaining liquid in the tank to flow into the sump 42 so that the liquid may be drained from the tank through the closable opening 44.

Thus it can be seen that the invention accomplishes at least all of its stated objectives.

We claim:

1. A plastic container for storing and dispensing a liquid, comprising:

a front wall, back wall, opposite side walls, a top and a bottom;

a top sump extending upwardly from said top adjacent said back wall and having a selectively closable drain/fill opening formed therein;

said bottom having an elongated bottom sump formed therein positioned between said front and back walls and which has forward and rearward ends;

said elongated bottom sump being positioned approximately midway between said opposite side walls;

said forward end of said bottom sump having a selectively closable drain opening formed therein;

said top having a selectively closable fill opening formed therein adjacent one of said opposite side walls.

2. The container of claim 1 wherein said top sump is positioned midway between said opposite side walls.

3. The container of claim 1 wherein a valve is positioned in said drain opening in said forward end of said bottom sump.

4. The container of claim 1 wherein said bottom has a pair of spaced-apart forklift pockets molded therein which extend between said front wall and said back wall.

5. The container of claim 1 wherein said forward end of said bottom sump is recessed inwardly of said front wall.

6. The container of claim 1 wherein the container is of one-piece molded construction.

7. The container of claim 6 wherein said bottom has a pair of spaced-apart forklift pockets molded therein which extend between said front wall and said back wall.

8. A liquid storage and dispensing system, comprising:

a support stand having an upper end with support legs extending downwardly therefrom for engagement with a supporting surface;

a first plastic tank positioned on said stand comprising: a front wall, back wall, opposite side walls, a top and a bottom; a top sump extending upwardly from said top adjacent said back wall and having a selectively closable drain/fill opening formed therein; said bottom having an elongated bottom sump formed therein positioned between said front and back walls and which has forward and rearward ends; said forward end of said bottom sump having a selectively closable drain opening formed therein; said top having a selectively closable fill opening formed therein adjacent one of said opposite side walls; said top wall having a pocket formed therein;

a second plastic tank positioned on said first plastic tank comprising: a front wall, back wall, opposite side walls, a top and a bottom; a top sump extending upwardly from said top adjacent said back wall and having a selectively closable drain/fill opening formed therein; said bottom having an elongated bottom sump formed therein positioned between said front and back walls and which has forward and rearward ends; said forward end of said bottom sump having a selectively closable drain opening formed therein; said top having a selectively closable fill opening formed therein adjacent one of said opposite side walls;

said bottom sump of said second tank being received in said pocket in said top wall of said first tank to prevent shifting of said second tank with respect to said first tank.

9. The system of claim 8 wherein said tops of said first and second tanks each have a raised central portion and wherein said pockets are formed in said central portions.

10. The system of claim 8 wherein said top sump in each of said tanks is positioned midway between said opposite side walls thereof.

11. The system of claim 8 wherein a valve is positioned in each of said drain openings in said forward end of said bottom sumps.

12. The system of claim 8 wherein said rearward end of each of said bottom sumps also has a selectively closable drain opening formed therein.

13. The system of claim 8 wherein said forward end of each of said bottom sumps is recessed inwardly of said front wall of each of said tanks.

14. The system of claim 8 wherein said bottom of each of said tanks has a pair of spaced-apart forklift pockets formed therein which extend between said front wall and said back wall.

15. The system of claim 8 wherein each of said tanks are of molded one-piece construction.

16. The system of claim 15 wherein each of said bottoms of said tanks have a pair of spaced-apart forklift pockets molded therein which extend between said front and back walls thereof.

17. A liquid storage and dispensing system, comprising:

a first plastic tank positioned on said stand comprising: a front wall, back wall, opposite side walls, a top and a bottom; a top sump extending upwardly from said top adjacent said back wall and having a selectively closable drain/fill opening formed therein; said bottom having an elongated bottom sump formed therein positioned between said front and back walls and which has forward and rearward ends; said forward end of said bottom sump having a selectively closable drain opening formed therein; said top having a selectively closable fill opening formed therein adjacent one of said opposite side walls; said top wall having a pocket formed therein;

a second plastic tank positioned on said first plastic tank comprising: a front wall, back wall, opposite side walls, a top and a bottom; a top sump extending upwardly from said top adjacent said back wall and having a selectively closable drain/fill opening formed therein; said bottom having an elongated bottom sump formed therein positioned between said front and back walls and which has forward and rearward ends; said forward end of said bottom sump having a selectively closable drain opening formed therein; said top having a selectively closable fill opening formed therein adjacent one of said opposite side walls;

said bottom sump of said second tank being received in said pocket in said top wall of said first tank to prevent shifting of said second tank with respect to said first tank.

18. The system of claim 17 wherein said tops of said first and second tanks each have a raised central portion and wherein said pockets are formed in said central portions.

19. The system of claim 17 wherein said top sump in each of said tanks is positioned midway between said opposite side walls thereof.

20. The system of claim 17 wherein a valve is positioned in each of said drain openings in said forward end of said bottom sumps.

21. The system of claim 17 wherein said rearward end of each of said bottom sumps also has a selectively closable drain opening formed therein.

22. The system of claim 17 wherein said forward end of each of said bottom sumps is recessed inwardly of said front wall of each of said tanks.

23. The system of claim 17 wherein said bottom of each of said tanks has a pair of spaced-apart forklift pockets formed therein which extend between said front wall and said back wall.

24. The system of claim 17 wherein each of said tanks are of molded one-piece construction.

25. The system of claim 24 wherein each of said bottoms of said tanks have a pair of spaced-apart forklift pockets molded therein which extend between said front and back walls thereof.

26. A plastic container for storing and dispensing a liquid, comprising:

a front wall, back wall, opposite side walls, a top and a bottom;

a top sump extending upwardly from said top adjacent said back wall and having a selectively closable drain/fill opening formed therein;

said bottom having an elongated bottom sump formed therein positioned between said front and back walls and which has forward and rearward ends;

said forward end of said bottom sump having a selectively closable drain opening formed therein;

said top having a selectively closable fill opening formed therein adjacent one of said opposite side walls;

said rearward end of said bottom sump also having a selectively closable drain opening formed therein.

27. A plastic container for storing and dispensing a liquid, comprising:

a front wall, back wall, opposite side walls, a top and a bottom;

a top sump extending upwardly from said top adjacent said back wall and having a selectively closable drain/fill opening formed therein;

said bottom having an elongated bottom sump formed therein positioned between said front and back walls and which has forward and rearward ends;

said forward end of said bottom sump having a selectively closable drain opening formed therein;

said top having a selectively closable fill opening formed therein adjacent one of said opposite side walls;

said top wall having a pocket formed therein which receives the lower end of the bottom sump of a tank when a pair of tanks are stacked one upon the other.

28. The container of claim 27 wherein said top has a raised central portion and wherein said pocket is formed in said raised central portion.

* * * * *